US007163268B2

(12) United States Patent
Sanada

(10) Patent No.: US 7,163,268 B2
(45) Date of Patent: Jan. 16, 2007

(54) INK JET RECORDING METHOD AND INK JET RECORDING APPARATUS

(75) Inventor: Kazuo Sanada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/287,777

(22) Filed: Nov. 5, 2002

(65) Prior Publication Data

US 2003/0090544 A1 May 15, 2003

(30) Foreign Application Priority Data

Nov. 5, 2001 (JP) ..... 2001-339271

(51) Int. Cl.
*B11J 2/01* (2006.01)

(52) U.S. Cl. ..... 347/11; 347/10; 347/15

(58) Field of Classification Search ..... 347/56, 347/11, 15, 10, 12, 19, 5
See application file for complete search history.

(56) References Cited

U.S. PATENT DOCUMENTS 6,022,092 A * 2/2000 Misumi ..... 347/10
6,533,399 B1 * 3/2003 Lee et al. ..... 347/61

FOREIGN PATENT DOCUMENTS

| | | |
|---|---|---|
| JP | 05-077422 | 3/1993 |
| JP | 11-263014 | 9/1999 |
| JP | 2000-141663 | 5/2000 |
| JP | 2001-088334 | 4/2001 |

* cited by examiner

*Primary Examiner*—Stephen Meier
*Assistant Examiner*—Lam Nguyen
(74) *Attorney, Agent, or Firm*—Whitham, Curtis, Christofferson & Cook, PC

(57) ABSTRACT

The ink jet recording method performs image recording by a top shooter type thermal ink jet system. Ink is heated with heaters to grow air bubbles until the air bubbles communicate with an atmosphere and ink droplets are ejected above the heaters. Subsidiary ink droplets are ejected before the ink is replenished to predetermined liquid surface levels at which primary ink droplets are ejected after the ink droplets were ejected. The ink jet recording apparatus includes heaters, ink supplying paths for supplying ink to the heaters and driving devices for driving the heaters to heat the ink. The ink ejection amount can be changed to record a high quality image through correction of variations in the ink ejection amount among nozzles and expression with a finer gradation.

14 Claims, 5 Drawing Sheets

INK JET RECORDING METHOD AND INK JET RECORDING APPARATUS

BACKGROUND OF THE INVENTION

1. Field of the Invention

The present invention relates to a technical field of a method and an apparatus for image recording by means of a top shooter type thermal ink jet system, and more particularly to an ink jet recording method and an ink jet recording apparatus that are capable of changing ink droplet ejection amounts in thermal ink jet system of atmosphere communication type, thereby achieving a uniform ink droplet ejection amount among nozzles and finer gradation.

2. Description of the Related Art

So-called thermal ink jet recording system in which a part of ink is rapidly vaporized through the application of heat by a heater and the ink (ink droplet) is ejected from a nozzle by the expansive force thereof or the like, is applied to various kinds of printers (see JP 48-9622 A, JP 54-51837 A).

In such a thermal ink jet system, the gradation of an image is expressed by adjusting the number of ink droplets to be ejected for one pixel, that is, by performing area modulation. With this method, however, the expressible graduation is limited in accordance with the resolution (spatial resolution) of an image and the like. In addition, the limit of the expressible gradation is low compared with image recording that uses a photosensitive material or the like.

In view of this problem, there has been studied a technique of enhancing the expression ability of gradation by changing an ejection amount of ink in the thermal ink jet system.

As a method of changing an ink ejection amount, there has been mainly proposed a method with which a plurality of heaters and nozzles are provided so as to correspond to one dot (the minimum expression unit) of ink and the numbers of heaters and nozzles to be driven are selected in accordance with an intended ink ejection amount.

With this method, however, it is required to use many heaters and nozzles whose numbers exceed the resolution of a recording head, so that in the case of a high-resolution recording head, it is required to perform extremely elaborate and high-density manufacturing processes, which leads to an increase in cost and a reduction in yield.

On the other hand, there have been also proposed various kinds of methods with which an ink ejection amount for one ink droplet is changed using one heater.

In JP 05-77422 A, for instance, there is disclosed an ink jet recording system in which the area of a nozzle opening is set larger than the area of a heater, thereby allowing an air bubble to grow until the air bubble exceeds the top end of a nozzle. The size of the air bubble is adjusted by adjusting energy supplied to the heater. By doing so, there is adjusted an ink ejection amount. With this method, however, the nozzle area is large compared with the heater, so that there occurs a loss in a portion of the growing energy of the air bubble, which is used for operations other than the formation of a droplet and the ejection of the droplet. Also, there is a fear that the direction in which the ink flies will become unstable.

Also, in JP 2000-141663 A, there is disclosed a technique with which there is formed for a heater a protective layer (passivation film) that includes areas having different thicknesses. With this construction, the amount of an ink droplet to be ejected is adjusted by applying a voltage to the heater in a multilevel manner and controlling a heater area that reaches the nucleate boiling temperature using the applied voltage.

With this method, however, there is formed a protective layer that includes areas having different thicknesses, which leads to an increase in the number of manufacturing processes and an increase in cost.

Further, JP 07-232441 A discloses a side shooter type ink jet recording apparatus in which a time interval from the preceding drive pulse is measured and intervals at which the ink ejection drive means is driven are controlled based on the measured time interval and the gradation information contained in the information to be printed.

It should be noted here that this recording system was made based on the finding that the size of an ink droplet that can be ejected at the following drive pulse can be changed for example to 40 to 100% in size of a common ink droplet by changing the time interval from the preceding drive pulse.

However, a first problem of the ink jet system of not atmosphere communication type but side shooter type disclosed in JP 07-232441 A is that the size of the ink droplet cannot be determined in a constant manner and is prone to be affected by the head structure corresponding to each ink jet nozzle in an ink jet head. Therefore, the prior art ink jet system suffers from the problem that its commercialization is difficult due to large variations in the individual head structures and also in the ink jet as a whole.

A second problem is that changes in the time interval between drive pulses may bring about variations in the ejection timing at which an ink droplet is ejected from each ink jet nozzle, which results in variations in the recording intervals on a recording medium leading to a marked reduction of the printing quality.

In order to solve this second problem, in the ink jet recording apparatus and method disclosed in JP 07-232441 A, a drive pulse having a minimal pulse width sufficient to always eject an ink droplet from an ink jet nozzle is used as an initial pulse; the initial pulse is regarded as the preceding drive pulse and thereafter main drive pulses are given at arbitrary time intervals to thereby controlling the variations in the recording intervals on the recording medium and preventing the printing quality from being markedly reduced.

Nevertheless, this is not effective in solving the first problem described above. The second problem is solved to some extent but the ink ejection drive means must be divided into two means including a first ink ejection drive means for driving at the initial pulse and a second ink ejection drive means for driving at the main drive pulse due to the difficulty in ejecting an ink droplet of minimal amount at the initial pulse in a positive and stabilized manner. In other words, there remains a problem that a special ink ejection drive means for the initial pulse is necessary in addition to the commonly used ink ejection drive means.

An object of the present invention is to solve the problems of the conventional techniques described above by providing an ink jet recording method that is capable of adjusting ink droplet ejection amounts using one ordinary heater (there are included construction elements such as a protective film), thereby correcting variations in ink ejection amounts among heaters and expressing with finer gradation in the so-called thermal ink jet system of atmosphere communication and top shooter type where an air bubble for ejecting ink is made to grow until the air bubble contacts the atmosphere.

Another object of the present invention is to provide an ink jet recording apparatus in which the ink jet recording method described above is implemented.

SUMMARY OF THE INVENTION

In order to attain the object described above, the present invention provides an ink jet recording method which performs image recording by a top shooter type thermal ink jet system comprising the steps of heating ink with heaters to grow air bubbles until the air bubbles communicate with an atmosphere and ejecting ink droplets from nozzles above the heaters, wherein subsidiary ink droplets are ejected before the ink is replenished to predetermined liquid surface levels at which primary ink droplets are ejected after the ink droplets were ejected.

Preferably, after the primary ink droplets have been ejected by supplying the ink to the predetermined liquid surface levels, the subsidiary ink droplets are ejected before the ink is replenished to the predetermined liquid surface levels at which the primary ink droplets are ejected again.

Also preferably, the image recording is performed by relatively moving an ink jet recording head having a row of the heaters arranged in one direction and an image receiving medium in a direction perpendicular to the one direction.

Further, preferably, in the image recording, first ejection intervals between the adjacent primary ink droplets ejected twice correspond to a resolution of an image to be recorded in the perpendicular direction and second ejection intervals between the primary ink droplets and the subsidiary ink droplets are shorter than the first ejection intervals between the primary ink droplets ejected twice.

Preferably, the primary ink droplets are ejected at least once in accordance with the resolution of the image to be recorded in the perpendicular direction after the predetermined liquid surface levels of the ink have been statically determined.

Preferably, the primary ink droplets and the subsidiary ink droplets are ejected through heating by identical heaters.

Preferably, after the primary ink droplets have been ejected, the subsidiary ink droplets are ejected several times before the primary ink droplets are ejected again.

In addition, the present invention provides an ink jet recording apparatus having an ink jet recording head of a top shooter type thermal ink jet system comprising heaters, ink supplying paths for supplying ink to the heaters, nozzles provided above the heaters, and driving means for driving the heaters to heat the ink so that air bubbles are generated to eject ink droplets above the heaters, wherein the driving means allows the air bubbles generated by the heaters to grow until the air bubbles communicate with an atmosphere thereby ejecting the ink droplets, and drives the heaters so that subsidiary ink droplets are ejected as necessary after the ink droplets have been ejected and before the ink is replenished to predetermined liquid surface levels at which primary ink droplets are ejected.

Preferably, the driving means drive the heaters so that, after the primary ink droplets have been ejected by supplying the ink to the predetermined liquid surface levels, the subsidiary ink droplets are ejected before the ink is replenished to the predetermined liquid surface levels at which the primary ink droplets are ejected again.

And, preferably, the ink jet recording head has a row of the heaters arranged in one direction and records an image on an image receiving medium relatively moved in a direction perpendicular to the one direction.

Preferably, the driving means drive the heaters so that second ejection intervals between the primary ink droplets and the subsidiary ink droplets are shorter than first ejection intervals between the primary ink droplets ejected twice which correspond to a resolution of an image to be recorded in the perpendicular direction.

Preferably, the driving means drive the heaters so that the primary ink droplets are ejected at least once in accordance with the resolution of the image to be recorded in the perpendicular direction after the predetermined liquid surface levels of the ink have been statically determined.

Also, preferably, the driving means drive identical heaters so that the primary ink droplets and the subsidiary ink droplets are ejected.

Also, preferably, the driving means drive the heaters so that after the primary ink droplets have been ejected, the subsidiary ink droplets are ejected several times before the primary ink droplets are ejected again.

DETAILED DESCRIPTION OF THE PREFERRED EMBODIMENTS

Hereinafter, the ink jet recording method and ink jet recording apparatus of the present invention will be described in detail based on the preferred embodiment shown in the accompanying drawings.

As in the illustrated case, the ink jet recording head used in the present invention is an ink jet recording head of the so-called top shooter type or face ink jet type in which ink is ejected in a direction substantially orthogonal to the surface of a substrate (or to a direction in which liquid is supplied to heaters), in other words, in a direction from the heaters towards the nozzles provided above, that is, over the heaters, and the thermal ink jet system of atmosphere communication type must be applied to this ink jet recording head. However, the present invention is not limited to the illustrated case as long as the ink jet recording head used is of top shooter type or face ink jet type utilizing the thermal ink jet system of atmosphere communication type.

Also, the ink jet recording head used in the present invention may be a small-sized ink jet recording head that supports for a carriage type printer that performs scanning in a direction orthogonal to a nozzle row arrangement direction using a carriage in combination with the intermittent conveyance of image receiving paper. Alternatively, the present invention may be applied to a so-called line head that has a construction where a row of nozzles extends so as to correspond to the overall region on one side of image receiving paper (or a region exceeding it).

Further, it does not matter whether the present invention is applied to monochrome printing or color printing. In the case of color printing, a color, for which the ink jet recording method of the present invention is applied, may coexist with a color for which the present invention is not applied.

Figure 1A:
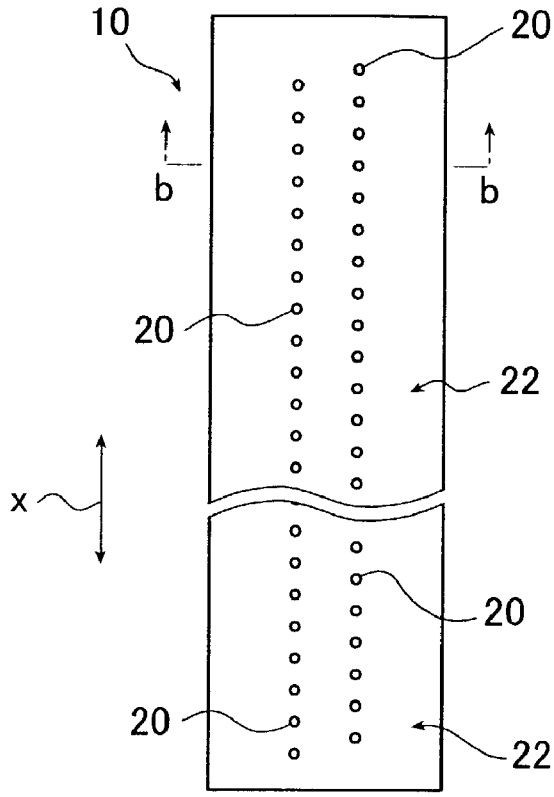
FIGS. 1A and 1B are schematic diagrams of an example of the ink jet recording head according to the present invention, with FIG. 1A being a plan view and FIG. 1B being a cross-sectional view taken along the line b—b in FIG. 1A.
Figure 1B:
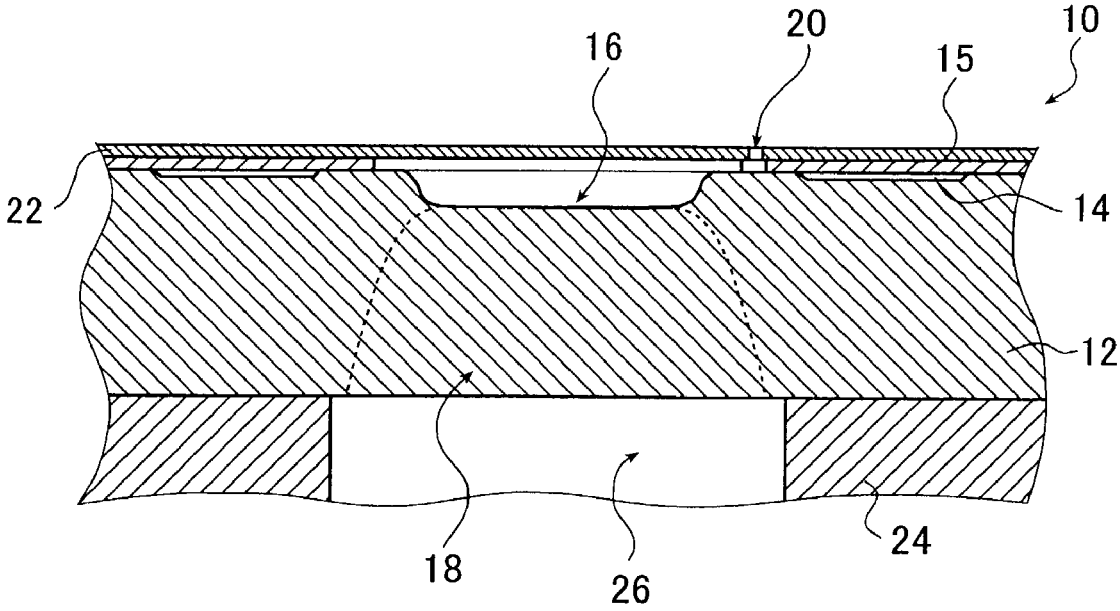

FIGS. 1A and 1B are schematic diagrams of an embodiment of the ink jet recording apparatus of the present invention that carries out the ink jet recording method of the present invention. FIG. 1A is a drawing (plan view) where the ink jet recording apparatus is viewed from a direction in which ink is ejected (flies), while FIG. 1B is a cross-sectional view taken along the line b—b in FIG. 1A.

An ink jet recording apparatus 10 (hereinafter referred to as the "recording head 10") in the illustrated embodiment is a so-called atmosphere communication type recording head where an air bubble generated by heating ink for ejecting the ink (ink droplet) communicates with the atmosphere by getting over (blocking) the ink.

In the illustrated case, the recording head 10 is produced by a silicon (Si) substrate using a manufacturing method for a semiconductor device, a photolithography technique, or the like, and basically comprises a substrate 12, an orifice plate 22 in which there have been formed nozzles 20 for ejecting ink droplets, and a partition wall 15 that is disposed therebetween and forms a path for supplying ink to each nozzle 20.

The recording head 10 includes many nozzles 20 arranged in one direction (direction vertical to the drawing plane in FIG. 1B). Accordingly, ink jet image recording is performed by modulation-driving a heater 30 (see FIGS. 2A and 2B) of each nozzle 20 in accordance with an image to be recorded while relatively moving an image receiving medium and the recording head 10 in a direction orthogonal to a row of the nozzles 20 (hereinafter referred to as the "nozzle row").

In the illustrated case, these two nozzle rows are used to eject ink in the same color and the recording density is improved by this construction where there are provided two nozzle rows. Note that the present invention is not limited to this and there occurs no problem even if there are provided a single nozzle row or three or more nozzle rows. Also, in the case where there are provided a plurality of nozzle rows, the color of ink to be ejected from each nozzle row and the combination thereof are arbitrarily determined.

The substrate 12 is fixed at a predetermined position of a frame 24 that serves as a supporting member, thereby installing the illustrated recording head 10. Also, this frame 24 is placed at a predetermined position of a predetermined unit (ink jet cartridge or the like, for instance) of an unillustrated ink jet printer, thereby placing the recording head 10 in the printer.

On the substrate 12, there are formed an ink groove 16 for supplying ink to ink supplying paths (see FIG. 2B, 52, 54) leading to each nozzle 20 and ink supplying holes 18 for supplying the ink to this ink groove 16. Also, for the frame 24 and the unit, there is formed an ink supplying path (ink flow path 26 in the frame 24) for supplying the ink from an ink tank (see FIG. 5A, 112) placed in the unit to the ink supplying holes 18 of the substrate 12.

In the illustrated case, the ink groove 16 is formed by digging down the surface (ink ejecting side surface) of the substrate 12 so as to extend in the nozzle row direction. On the other hand, a plurality of ink supplying holes 18 are punched from the underside so as to communicate with the ink groove 16 on the upper surface side of the Si substrate 12 by passing through the Si substrate 12 and to be arranged in the nozzle row direction at regular intervals.

Figure 2A:
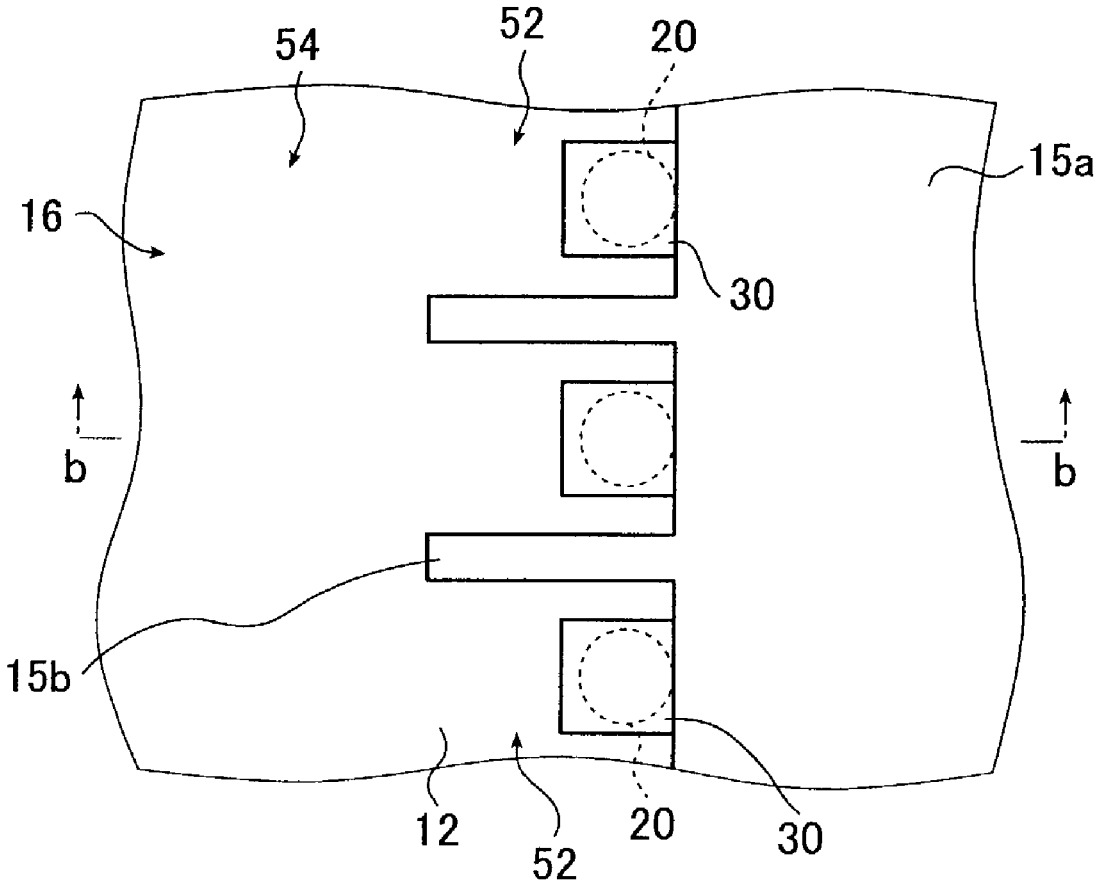
FIGS. 2A and 2B are partial enlarged views of FIGS. 1A and 1B, with FIG. 2A being a plan view and FIG. 2B being a cross-sectional view taken along the line b—b in FIG. 2A.
Figure 2B:
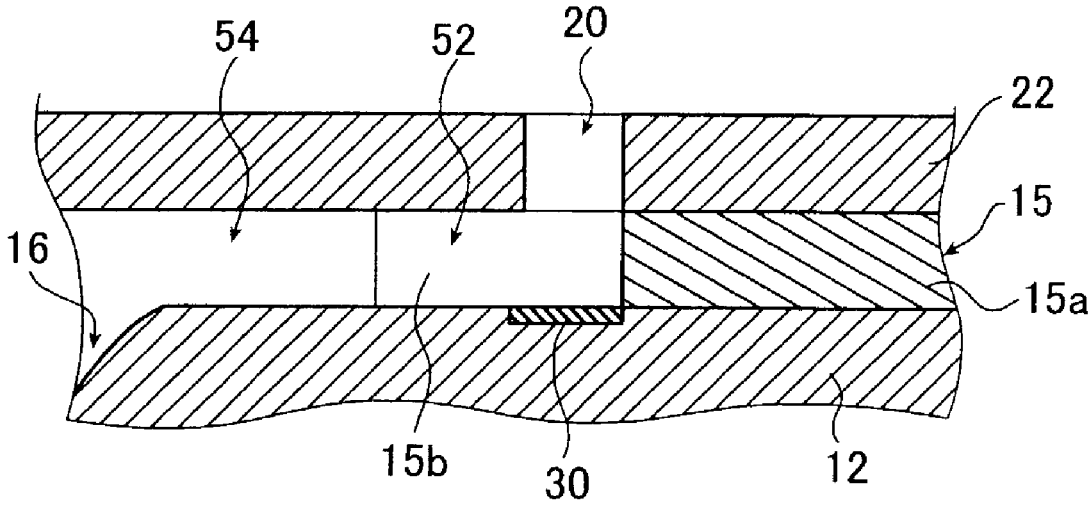

FIGS. 2A and 2B are each a schematic cross-sectional view showing the vicinity of the nozzles. Note that like FIGS. 1A and 1B, FIG. 2A is a plan view and FIG. 2B is a cross-sectional view taken along the line b—b in FIG. 2A. Note that in FIG. 2A, in order to more clearly illustrate the construction, the orifice plate 22 is omitted and the nozzles 20 are shown using dotted lines.

In the recording head 10, the partition wall 15 that forms ink supplying paths (52, 54) from the ink groove 16 to each nozzle 20 (each heater 30) is stacked on the substrate 12.

In the illustrated case, the partition wall 15 includes a region 15*a* that covers the entire surface on a side opposite to the ink groove 16 with respect to the nozzles 20 and partition portions 15*b* formed between respective nozzles 20 so as to protrude from this region 15*a* toward the ink groove 16. Individual (ink) flow paths 52 for supplying the ink to respective nozzles 20 are formed by these partition portions 15*b*, and each region on the substrate 12 that does not include this partition portion 15*b* serve as a common (ink) flow path 54 that is common to all of the nozzles 20.

That is, in the recording head 10 of the illustrated case, the ink is supplied from the ink tank through the ink flow path 26 formed in the frame 24, and is finally supplied to each nozzle 20 by flowing through the ink supplying holes 18, the ink groove 16, the common flow path 54, and the individual flow paths 52 in this order.

In the present invention, when the cross sections of the individual flow paths 52 formed by the partition portions 15*b* of the partition wall 15 (cross sections in a direction orthogonal to a direction in which the ink mainly flow) are compared with cross sections of the nozzles 20 (same as above), the cross sections of the individual flow paths 52 are preferably smaller than the cross sections of the nozzles 20.

By adopting the construction like this, it becomes possible to accelerate a speed at which the ink covers the heaters 30 during the refilling after ejection (to be described later) and to elongate a time until the subsequent refilling is completed. As a result, it becomes possible to perform the multilevel, fine changing of an ink ejection amount (to be described later) more easily. As a result, the expression power can be further improved by a finer gradation.

The orifice plate 22, in which the nozzles 20 (nozzle row) for ejecting droplets are formed, is stacked on this partition wall 15.

On the substrate 12, the heaters 30 that function as means for ejecting ink droplets are formed so as to correspond to respective nozzles 20 (individual flow paths 52) and there is further formed a driving LSI 14 (see FIGS. 1A and 1B) that modulation-drives each heater 30.

As described above, the recording head 10 of the present invention is a thermal ink jet head of atmosphere communication type in which each heater 30 (driving LSI 14) allows an air bubble for ejecting an ink droplet to grow until the air bubble communicates with the atmosphere by getting over (blocking) the ink. Accordingly, in the recording head 10, of the ink contained in the individual flow paths 52, ink existing above the heaters 30, that is, ink in the projection areas of the heaters 30 and ink in the nozzles 20 corresponding to the heaters 30 are basically all ejected by one ink ejecting operation. In other words, an ink ejection method called "complete ejection" is performed.

Here, in the recording head 10 of the present invention, after ink has been ejected or primary ink droplets have been ejected in accordance with the resolution of an image to be recorded in a direction perpendicular to the nozzle row direction, the ink is supplied through the ink supplying paths (52, 54, 16, 18, 26). The driving LSIs 14 drive the heaters 30 before the ink is replenished, for example, to predetermined liquid surface levels in the nozzles 20 at which the primary ink droplets have been ejected, and preferably before the liquid surface levels in the nozzles 20 are statically determined (before the end of refilling), thereby ejecting subsidiary ink droplets from the nozzles 20. By doing so, the ink ejection amount (total ink ejection amount of the primary ink droplets and subsidiary ink droplets) can be changed to express with a finer gradation for instance, or differences in the ink ejection amount among the nozzles can be eliminated to record a high quality image.

The term "primary ink droplet" used herein refers to an ink droplet that is ejected in the state in which ink is supplied to a predetermined liquid surface level, and the term "subsidiary ink droplet" refers to an ink droplet that is ejected after the primary ink droplet has been ejected and before the ink is replenished to the predetermined liquid surface level at which the primary ink droplet is ejected again.

Therefore, in image recording relying on the ink jet recording method of the present invention, the ejection interval between successive two primary droplets corresponds to the resolution of an image to be recorded in a direction perpendicular to the nozzle row direction, and the ejection interval between the primary droplet and the subsidiary droplet is shorter than the ejection interval between the successive two primary ink droplets.

Hereinafter, there will be described an operation during this ejection process.

Figure 3A:
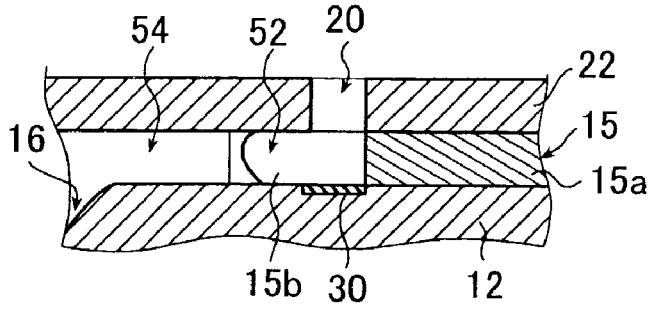
FIGS. 3A to 3E are each a conceptual diagram for illustrating the ink jet recording method of the present invention.

As described above, the recording head 10 of the present invention is of atmosphere communication type, so that ink existing above the heaters 30 is all ejected and ink liquid surfaces after the ejection of the ink exist at the position shown in FIG. 3A, for instance.

Figure 3B:
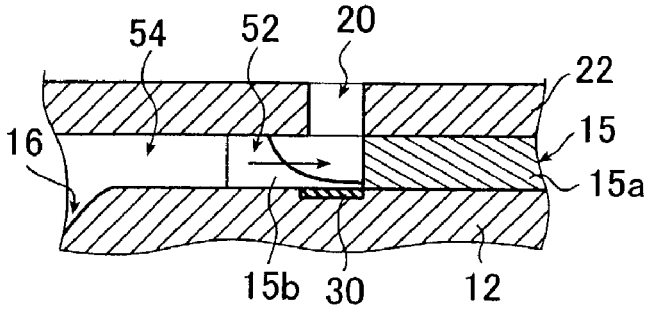
Figure 3C:
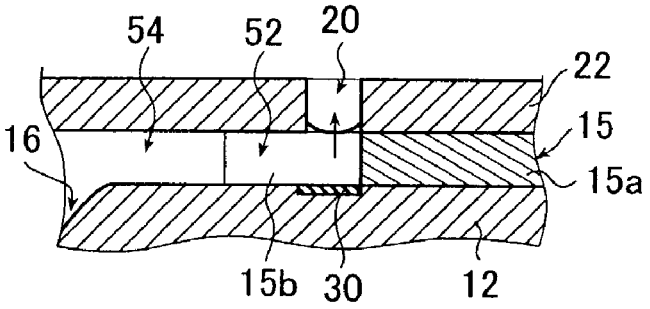
Figure 3D:
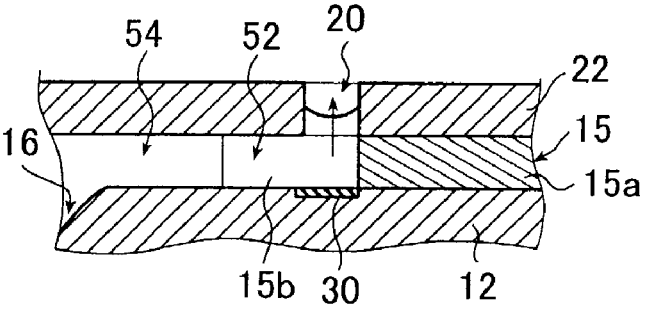
Figure 3E:
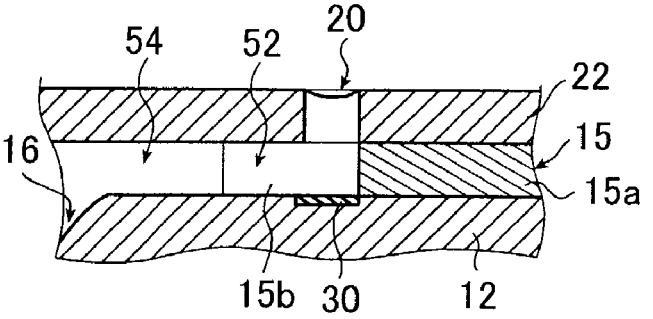

If refilling is started under this state, the ink flows toward the heaters 30 (in the rightward direction in the drawing) due to a capillary phenomenon and the ink is replenished and covers the entire surfaces of the heaters 30, as shown in FIG. 3B. Next, as shown in FIG. 3C, the ink surfaces advance upwardly and the individual flow paths 52 between the bottom end surfaces of the nozzles 20 (orifice plate 22) and the heaters 30 (upper surface of the substrate 12) are filled with the ink. Further, as shown in FIG. 3D, the ink is further replenished and the ink surfaces advance more upwardly. Finally, as shown in FIG. 3E, ink surfaces (meniscus) reach the predetermined liquid surface levels at which the primary ink droplets are ejected, and are preferably statically determined (stabilized) at the predetermined liquid surface levels and refilling is completed.

As described above, the recording head 10 of the present invention is of atmosphere communication type in which ink positioned above the heaters 30 is all ejected by one ejecting operation. Accordingly, after the ink has been ejected, preferably after the primary ink droplets have been ejected, and more preferably after the ink covers the entire surfaces of the heaters 30 as shown in FIG. 3B, the refilled ink reaches the predetermined liquid surface levels at which refilling for the following ejection of the primary ink droplets is completed. Before the end of the refilling, the heaters 30 are driven at an arbitrary timing to eject the subsidiary ink droplets whereupon small sized ink droplets can be ejected. In addition, as is apparent from FIGS. 3A to 3E, it is possible to change the amount of the subsidiary ink droplets to be ejected in accordance with a lapse of time after the previous ink droplet ejection (from the start of refilling), to be more specific, after the primary ink droplets or subsidiary ink droplets have been ejected (as a matter of course, the ink amount is increased in accordance with the elongation of a time lapsed after the previous ejection). In addition, the recording head 10 is of atmosphere communication type in which the ink above the heaters 30 is all ejected, so that the ejection amount of ink in accordance with this lapse of time is also stabilized.

That is, in accordance with the present invention, it is not required to provide a plurality of heaters. Also, without subjecting a protective film or the like to special processing and without changing the electric power applied to the heater, it is possible to change the ejection amount of ink with stability merely by selecting/setting the ink ejection timing using an ordinary recording head.

In the recording head 10 of the illustrated example, during the ink ejection for one dot (which is the minimum expression unit) corresponding to the resolution (spatial resolution) of an image to be recorded, first, the primary ink droplets are ejected once after the end of refilling. When it is necessary, for example, to increase the ink ejection amount for a finer gradation or remove the variations in the ink ejection amount among the nozzles 20, the subsidiary ink droplets are ejected once as required at an arbitrary timing before the refilling for the following ejection of the primary ink droplets is completed (inclusive of the moment at which the refilling is completed). That is, when the subsidiary ink droplets are ejected, the ejection intervals between the primary ink droplets and the subsidiary ink droplets (cycle of modulation) are shorter than the intervals of ejection for one dot corresponding to the resolution of an image to be recorded, that is, the ejection intervals between the successive two primary ink droplets in accordance with the resolution of an image to be recorded. The subsidiary ink droplets having an ink amount corresponding to that of the primary ink droplets may be ejected after the end of refilling if the subsidiary ink droplets can be ejected at shorter intervals than the intervals at which the primary ink droplets are ejected in accordance with the resolution of an image to be recorded. In other words, according to the present invention, the ink droplets ejected at shorter intervals than the ejection intervals between the successive two primary ink droplets in accordance with the resolution of an image to be recorded are considered to be the subsidiary ink droplets even if they are the primary ink droplets ejected after the end of refilling.

In other words, one dot corresponding to the resolution of an image to be recorded is formed by two sub-dots including a sub-dot depending on the primary ink droplets after the end of refilling and a sub-dot depending on the subsidiary ink droplets which are ejected as necessary before the end of refilling. In this manner, there are expressed different densities for one dot.

Figure 4:
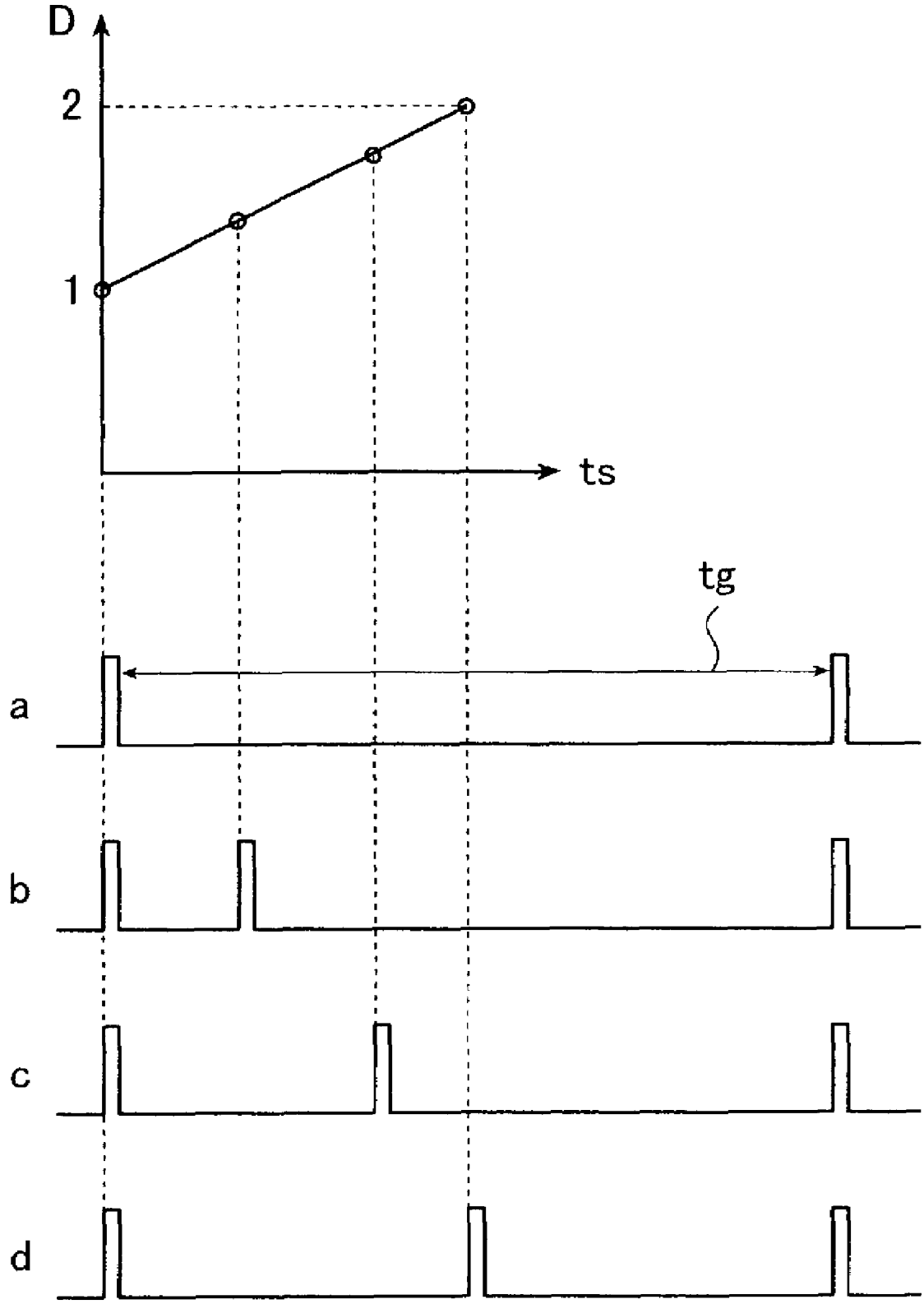
FIG. 4 is a conceptual diagram for illustrating an embodiment of the ink jet recording method of the present invention.

To be more specific, as is schematically shown in FIG. 4, when the ejection intervals for one dot corresponding to the resolution is referred to as "tg", the primary ink droplets are ejected once after the end of refilling, and thereafter the subsidiary ink droplets are ejected as necessary when a time "ts" whose length is shorter than "tg" has lapsed, thereby adjusting the ink ejection amount for one dot.

Here, it is assumed that the density (D) in the ejection of the primary ink droplets performed after the end of refilling is set at "1" and the primary ink droplets are ejected after the end of refilling in the first ink ejection for one dot. That is, as to the graphs "a" to "d" in FIG. 4, the most right side in FIG. 4 shows the ejection of the primary ink droplets for the next one dot.

During this operation, if the primary ink droplets are ejected only in the first ejection as shown by the graph "a" in FIG. 4, the density of one dot becomes "1". In contrast to this, if the subsidiary ink droplets are ejected at the timing shown by the graph "b" as the second ejection in addition to the primary ink droplets first ejected, the density of one dot is increased. If the subsidiary ink droplets are ejected in the second ejection at the timing shown by the graph "c", the density of one dot is further increased. Further, if the subsidiary ink droplets whose size is equivalent to that of the primary ink droplets are ejected in the second ejection at the timing shown by the graph "d" (at the end of refilling), the density of one dot is doubled and becomes "2".

Accordingly, a difference from an appropriate ink ejection amount is detected for each nozzle, the timing "ts" at which the subsidiary ink droplets are ejected in the second ejection is determined for each nozzle 20 in accordance with the detected difference, and each nozzle 20 is controlled so that the subsidiary ink droplets are always ejected in the second ejection at the same timing "ts" using the driving LSI 14. By doing so, it becomes possible to correct variations in the ink ejection amount among the nozzles 20 and to record a higher quality image that has no uneven color or uneven density.

Alternatively, if the driving LSI 14 changes the ejection timing "ts" at which the subsidiary ink droplets are ejected in the second ejection in accordance with an image to be recorded (density of each pixel to be recorded), that is, in accordance with image data, it becomes possible to perform gradation expression through the changing of ink ejection amounts in addition to the gradation expression through the ordinary area modulation. As a result, it becomes possible to record an image which is expressed with a finer gradation.

In the present invention, no specific limitation is imposed on the timing at which the subsidiary ink droplets are ejected before the end of refilling and this ink ejection may be performed at any timing. In the present invention that applies the atmosphere communication type, the ink above the heaters 30 is all ejected in the form of ink droplets. Then, the ink ejection amounts are constant not only for the primary ink droplets but also the subsidiary ink droplets. Nevertheless, in order to further stabilize the ink ejection amounts and hence the size of each subsidiary ink droplet, it is preferable that this ink ejection is performed after refilled ink covers the entire surfaces of the heaters 30. In particular, in the case of a type like the illustrated recording head 10 that includes the nozzles 20, the ink ejection amounts are further stabilized by ejecting the subsidiary ink droplets after the individual flow paths 52 between the bottom end surfaces of the nozzles 20 and the heaters 30 are filled with the ink, as shown in FIG. 3C.

It should be noted here that in the case where the primary ink droplets are always ejected once after the end of refilling for one dot corresponding to the recording resolution like in the illustrated case, it is preferable that the last ejection of ink droplets for one dot is performed in accordance with the ink droplet ejection timing corresponding to the resolution at the timing at which refilling is completed before the ejection timing of the primary ink droplets for the next dot is started.

In the case shown in FIG. 4, the ink droplet ejection for one dot is performed twice including the ejection of the primary ink droplets and that of the subsidiary ink droplets. The present invention is not however limited to this. If possible, the ink ejection for one dot may be performed three or more times in accordance with ejection timings corresponding to the resolution, a time taken to perform refilling, and the like. To be more specific, in addition to the ejection of the primary ink droplets, the subsidiary ink droplets may be ejected twice or more times.

Further, the primary ink droplets are always ejected once for one dot after the end of refilling in the case shown in FIG. 4. However, the present invention is not limited to this. Only the subsidiary ink droplets may be always ejected before refilling. However, during ordinary image recording, all nozzles do not necessarily eject ink, so that there necessarily exist nozzles that are refilled. Accordingly, this method is effective in the case where there is recorded a specific image such as a template or an image having a fixed pattern.

Figure 5A:
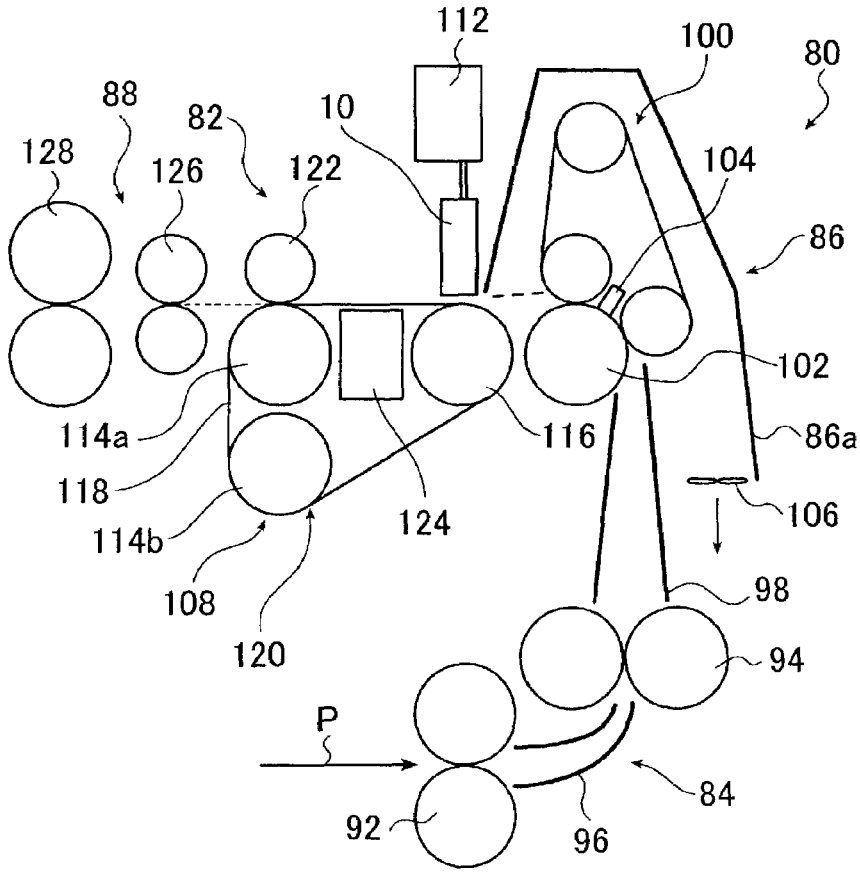
FIGS. 5A and 5B are conceptual diagrams of an example of the ink jet printer of the present invention, with FIG. 5A being a side view and FIG. 5B being a perspective view.
Figure 5B:
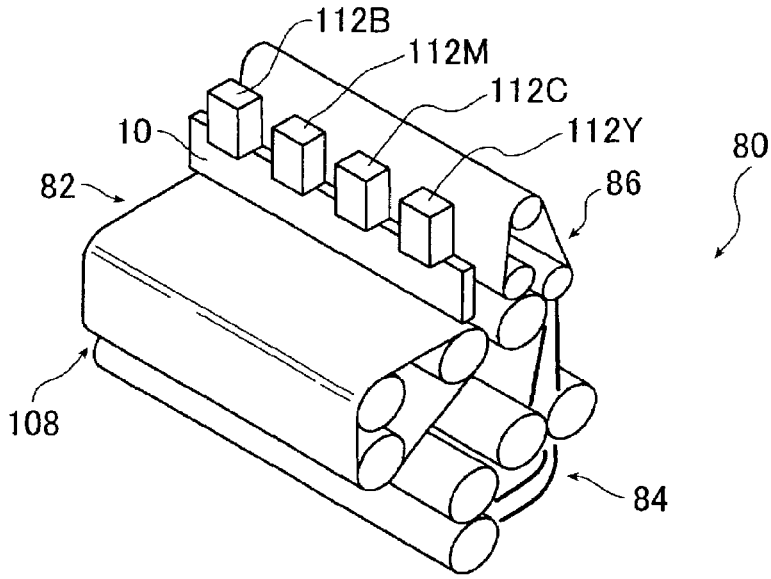

FIGS. 5A and 5B show an example of an ink jet printer that uses the recording head 10 of the present invention. Note that FIG. 5A is a conceptual diagram (side view) viewed from the nozzle row direction to show the construction of this ink jet printer. Also, FIG. 5B is a conceptual diagram (perspective view) where this ink jet printer is viewed from a diagonal direction.

In an ink jet printer 80 (hereinafter referred to as the "printer 80") shown in FIGS. 5A and 5B, a line head including a nozzle row that extends in one direction of corresponding image receiving paper P over its width is used as the recording head 10. This printer 80 is basically a publicly known ink jet printer except that there is used the recording head 10 according to the present invention, that is, except that there is carried out the recording method of the present invention.

The printer 80 shown in FIGS. 5A and 5B comprises a recording portion 82 that uses the recording head 10 of the present invention, a sheet feeding portion 84, a pre-heat portion 86, and a sheet discharging portion 88 (omitted in FIG. 5B).

The sheet feeding portion 84 includes two pairs of conveying rollers 92 and 94 and guides 96 and 98. Image receiving paper P is conveyed by the sheet feeding portion 84 upwardly from a horizontal direction and is fed to the pre-heat portion 86.

The pre-heat portion 86 includes a conveyer 100 constructed from three rollers and an endless belt, a press-contacting roller 102 that is pressed against the endless belt from the outside of the conveyer 100, a heater 104 that is pressed against the press-contacting roller 102 from the inside of the conveyer 100, and a ventilating fan 106 for ventilating the inside of a housing 86*a*.

The pre-heat portion 86 like this applies heat to the image receiving paper P prior to ink jet image recording, thereby promoting the drying of ink. The image receiving paper P conveyed from the sheet feeding portion 84 is nipped and conveyed by the conveyer 100 and the press-contacting roller 102, is heated by the heater 104, and is conveyed to the recording portion 82.

The recording portion 82 includes the aforementioned recording head 10 of the present invention (unit in which the recording head 10 has been installed) and a recording and conveying means 108. Also, four recording heads 10 (units) are arranged and one ink tank 112 (112Y, 112C, 112M, and 112B) is placed for each recording head.

The recording and conveying means 108 includes a conveyer 120 constructed from rollers 114*a* and 114*b*, a suction roller 116, and a porous endless belt 118; a nip roller 122 (omitted in FIG. 5B) that is pressed against the porous endless belt 118 (roller 114*a*); and a suction box 124 within the conveyer 120.

The recording head 10 is placed at the bottom end (image receiving paper P side in the lower portion in the drawing) of the head unit so that the nozzles 20 are directed toward the suction roller 116. Also, the recording and conveying means 108 successively conveys the image receiving paper P at a predetermined speed in a direction orthogonal to the nozzle row direction. Accordingly, the entire surface of the image receiving paper P supplied from the pre-heat portion 80 is scanned by the nozzle row of the recording head 10, which is a line head, and an image is recorded. Here, from each nozzle 20 of the recording head 10, in accordance with an image to be recorded (or a correction of errors in ejection amount among nozzles), for one dot recording, the primary ink droplets are ejected once after the end of refilling, and the subsidiary ink droplets are ejected as required before refilling, which is as described above. Although the driving LSI 14 controls the ink droplet ejection in the case described above, such ink droplet ejection may be controlled by a recording control means set in the printer 80.

Also, the conveyer 120 has the porous endless belt 118 and further includes the suction roller 116 and the suction box 124. As a result of this construction, the image receiving paper P is conveyed under a state where this paper is attached to the porous endless belt 118 and an image is recorded under a state where this paper is properly held at a predetermined position with respect to the recording head 10.

The image receiving paper P, on which an image has been recorded, is fed to the sheet discharging portion 88, is conveyed by a conveying roller pair 126 and discharging rollers 128, and is discharged onto a discharge tray for example.

An ink jet printer that uses the recording head 10 of the present invention is not limited to the embodiment described above and various kinds of publicly known ink jet printers are usable. For instance, the ink jet printer may be a printer of carriage type that scans a recording head (head unit) using a carriage while intermittently conveying the image receiving paper described above. Also, the ink jet printer may include a feeder or the like that automatically feeds the image receiving paper.

The ink jet recording method and the ink jet recording head of the present invention have been described in detail above, although the present invention is not limited to the embodiment described above. That is, it is possible to make various kinds of modifications and changes without departing from the gist of the present invention.

For instance, the recording head 10 described above includes the nozzles 20 for ejecting ink, although the present invention is not limited to this. That is, there occurs no problem even if the recording head 10 is a so-called nozzleless ink jet recording head, such as the recording head disclosed in JP 08-290587 A, JP 11-286104 A, JP 2001-88334 A, or the like, so long as the recording head 10 is a thermal ink jet head of atmosphere communication type.

As has been described in detail above, according to the present invention, in thermal ink jet system, without using a special construction including a plurality of heaters, a protective film that includes areas having different thicknesses, or the like and without performing an operation such as the changing of an applied electric power, it becomes possible to change an ink ejection amount by a simple operation in which there is selected an ink ejection timing and to record a high quality image through correction of variations in the ink ejection amount among nozzles and expression with a finer gradation.

What is claimed is:

1. An ink jet recording method which performs image recording by a top shooter type thermal ink jet system, comprising the steps of:

heating ink with heaters to grow air bubbles until the air bubbles communicate with an atmosphere; and ejecting primary and subsidiary ink droplets above the heaters, a total ink ejection amount for a pixel being the sum of a primary ink droplet and one or more subsidiary ink droplets; wherein said one or more subsidiary ink droplets are ejected before the ink is replenished to predetermined liquid surface levels at which primary ink droplets are ejected after respective ones of said primary or subsidiary ink droplets were ejected and wherein a gradation in the total ink ejection amount is variably controlled by adjusting an amount of each of said one or more subsidiary ink droplets in accordance with a lapse of time after a previous primary or subsidiary ink droplet ejection to variably control a level to which said ink is replenished when each of said one or more subsidiary ink droplets is ejected.

2. The ink jet recording method according to claim 1, wherein, after said primary ink droplets have been ejected by supplying said ink to said predetermined liquid surface levels, said subsidiary ink droplets are ejected before said ink is replenished to said predetermined liquid surface levels at which said primary ink droplets are ejected again.

3. The ink jet recording method according to claim 2, wherein said image recording is performed by relatively moving an ink jet recording head having a row of said heaters arranged in one direction and an image receiving medium in a direction perpendicular to said one direction and wherein, in said image recording, first ejection intervals between said primary ink droplets ejected twice correspond to a resolution of an image to be recorded in said perpendicular direction and second ejection intervals between said primary ink droplets and said subsidiary ink droplets are shorter than the first ejection intervals between said primary ink droplets ejected twice.

4. The ink jet recording method according to claim 3, wherein said primary ink droplets are ejected at least once in accordance with the resolution of the image to be recorded in said perpendicular direction after said predetermined liquid surface levels of said ink have been statically determined.

5. The ink jet recording method according to claim 2, wherein said primary ink droplets and said subsidiary ink droplets are ejected through heating by identical heaters.

6. The ink jet recording method according to claim 2, wherein after said primary ink droplets have been ejected, said subsidiary ink droplets are ejected several, times before said primary ink droplets are ejected again.

7. The ink jet recording method according to claim 1, wherein said image recording is performed by relatively moving an ink jet recording head having a row of said heaters arranged in one direction and an image receiving medium in a direction perpendicular to said one direction.

8. An ink jet recording apparatus having an ink jet recording head of a top shooter type thermal ink jet system, comprising:

heaters;

ink supplying paths for supplying ink to the heaters; and driving means for driving said heaters to heat the ink so that air bubbles are generated to eject primary and subsidiary ink droplets above said heaters, a total ink ejection amount for a pixel being the sum of a primary ink droplet and one or more subsidiary ink droplets, wherein said driving means allows the air bubbles generated by each of said heaters to grow until the air bubbles communicate with an atmosphere thereby ejecting said primary or subsidiary ink droplets, and drives said heaters so that said one or more subsidiary ink droplets are ejected as necessary after respective ones of said primary ink droplets have been ejected and before the ink is replenished to predetermined liquid surface levels at which primary ink droplets are ejected and wherein a gradation in the total ink ejection amount is variably controlled by adjusting an amount of each of said one or more subsidiary ink droplets in accordance with a lapse of time after a previous primary or subsidiary ink droplet ejection to variably control a level to which said ink is replenished when each of said one or more subsidiary ink droplets is elected.

9. The ink jet recording apparatus according to claim 8, wherein said driving means drive said heaters so that, after said primary ink droplets have been ejected by supplying said ink to said predetermined liquid surface levels, said subsidiary ink droplets are ejected before said ink is replenished to said predetermined liquid surface levels at which time said primary ink droplets are ejected again.

10. The ink jet recording apparatus according to claim 9, wherein said ink jet recording head has a row of said heaters arranged in one direction and records an image on an image receiving medium relatively moved in a direction perpendicular to said one direction and wherein, in image recording, said driving means drive said heaters so that second ejection intervals between said primary ink droplets and said subsidiary ink droplets are shorter than first ejection intervals between said primary ink droplets ejected twice which correspond to a resolution of an image to be recorded in said perpendicular direction.

11. The ink jet recording apparatus according to claim 10, wherein said driving means drive said heaters so that said primary ink droplets are ejected at least once in accordance with the resolution of the image to be recorded in said perpendicular direction after said predetermined liquid surface levels of said ink have been statically determined.

12. The ink jet recording apparatus according to claim 9, wherein said driving means drive identical heaters for ejection of said primary ink droplets and said subsidiary ink droplets.

13. The ink jet recording apparatus according to claim 9, wherein said driving means drive said heaters so that after said primary ink droplets have been ejected, said subsidiary ink droplets are ejected several times before said primary ink droplets are ejected again.

14. The ink jet recording apparatus according to claim 8, wherein said ink jet recording head has a row of said heaters arranged in one direction and records an image on an image receiving medium relatively moved in a direction perpendicular to said one direction.

* * * * *